US010143884B2

(12) United States Patent
Cei

(10) Patent No.: US 10,143,884 B2
(45) Date of Patent: Dec. 4, 2018

(54) CURVED TREADMILL

(71) Applicant: Technogym S.p.A., Gambettola, Forli'-Cesena (IT)

(72) Inventor: Daniele Cei, Cesenatico (IT)

(73) Assignee: Technogym S.p.A., Gambettola (IT)

( * ) Notice: Subject to any disclaimer, the term of this patent is extended or adjusted under 35 U.S.C. 154(b) by 6 days.

(21) Appl. No.: 14/791,828

(22) Filed: Jul. 6, 2015

(65) Prior Publication Data

US 2016/0023039 A1 Jan. 28, 2016

(30) Foreign Application Priority Data

Jul. 25, 2014 (IT) ..... MI2014A1357

(51) Int. Cl.

| | |
|---|---|
| ***A63B 22/00*** | (2006.01) |
| ***A63B 22/02*** | (2006.01) |
| ***A63B 21/00*** | (2006.01) |
| ***A63B 23/04*** | (2006.01) |
| ***A63B 24/00*** | (2006.01) |

(52) U.S. Cl.

CPC ..... *A63B 22/0285* (2013.01); *A63B 21/154* (2013.01); *A63B 22/02* (2013.01); *A63B 22/0242* (2013.01); *A63B 23/04* (2013.01); *A63B 24/0087* (2013.01); *A63B 2022/0278* (2013.01); *A63B 2220/80* (2013.01); *A63B 2220/833* (2013.01); *A63B 2225/72* (2013.01)

(58) Field of Classification Search

CPC . A63B 22/02; A63B 22/0285; A63B 22/0242; A63B 24/0087; A63B 21/154; A63B 2022/0278; A63B 2220/833; A63B 22/0207–22/0235; A63B 22/025; A63B 22/0257; A63B 22/0292; A63B 2022/0271

See application file for complete search history.

(56) References Cited

U.S. PATENT DOCUMENTS

| | | | | |
|---|---|---|---|---|
| 1,211,765 A * | 1/1917 | Schmidt | A63B 22/02 | 482/54 |
| 5,000,440 A * | 3/1991 | Lynch | A63B 21/0615 | 482/112 |
| 5,104,119 A * | 4/1992 | Lynch | A63B 21/00072 | 482/113 |
| 5,299,454 A | 4/1994 | Fuglewicz et al. | | |
| 5,709,632 A * | 1/1998 | Socwell | A63B 22/0012 | 482/51 |

(Continued)

FOREIGN PATENT DOCUMENTS

| | | |
|---|---|---|
| JP | 2000-140151 A | 5/2000 |
| WO | WO 2006/062319 A1 | 6/2006 |
| WO | WO 2010/107632 A1 | 9/2010 |

*Primary Examiner* — Stephen R Crow

(74) *Attorney, Agent, or Firm* — Blank Rome LLP

(57) ABSTRACT

A curved treadmill with a base having a physical exercise surface configured for rotating around a first roller and a second roller, converting the potential energy of the user on the physical exercise surface into rotational kinetic energy. A first coupling device operatively connects a first pulley to the first roller. The first coupling device allows the first pulley and the first roller to revolve if the rotational speed of the first roller is equal to or greater than the rotational speed of the first pulley, and prevents the first pulley and the first roller from rotating if the rotational speed of the first roller is less than the rotation speed of the first pulley.

18 Claims, 6 Drawing Sheets

(56) References Cited

U.S. PATENT DOCUMENTS

| | | | | | |
|---|---|---|---|---|---|
| 5,897,461 | A * | 4/1999 | Socwell | A63B 22/0012 | 482/54 |
| 6,010,432 | A * | 1/2000 | Vawter | A61H 15/00 | 482/54 |
| 6,053,848 | A * | 4/2000 | Eschenbach | A63B 22/0207 | 482/51 |
| 6,152,854 | A * | 11/2000 | Carmein | A63B 22/025 | 198/779 |
| 8,343,016 | B1 * | 1/2013 | Astilean | A63B 21/156 | 482/54 |
| 9,186,552 | B1 * | 11/2015 | Deal | A63B 24/0087 | |
| 2007/0167290 | A1 * | 7/2007 | Kim | A63B 22/0087 | 482/54 |
| 2012/0010048 | A1 * | 1/2012 | Bayerlein | A63B 21/0053 | 482/2 |
| 2012/0157267 | A1 * | 6/2012 | Lo | A63B 22/02 | 482/54 |
| 2013/0184125 | A1 * | 7/2013 | Maguire | A63B 22/02 | 482/54 |
| 2014/0011642 | A1 * | 1/2014 | Astilean | A63B 22/02 | 482/54 |
| 2015/0080181 | A1 * | 3/2015 | Skulman | A63B 24/0075 | 482/3 |
| 2016/0144225 | A1 * | 5/2016 | Dalebout | A63B 22/02 | 482/54 |
| 2016/0166877 | A1 * | 6/2016 | Cei | A63B 22/02 | 482/54 |

* cited by examiner

CURVED TREADMILL

BACKGROUND OF THE INVENTION

1. Field of the Invention

The present invention refers to the field of treadmills and in particular to a curved treadmill.

2. Description of the Related Art

As is known, a curved treadmill is a motor-less exercise machine that can be manually actuated by the user by means of the interactions of the lower limbs with the running/walking belt.

A curved treadmill typically comprises a base on which a frame is mounted with handles extended vertically with respect to the base.

The base is extended along a direction of longitudinal development parallel to the direction of user advancement during the walk or run.

The base comprises a first front roller and a second rear roller, around which the running/walking belt is windingly mounted.

The belt for the running/walking of the user is mounted on the first front roller and on the second rear roller in a manner such that it has, in the part directed upward, a lateral profile that is curved along the direction of longitudinal development of the base and with respect thereto; that is, it has a first portion that is descending starting from the first roller and a second portion, opposite the first portion, that is ascending towards the second roller.

During the run or walk of the user on the running/walking belt, the weight force exerted by the user at the first descending portion of the running/walking belt allows transforming the potential energy into kinetic energy, and consequently generating the rotation of the running/walking belt only through the interaction of the lower limbs of the user with the running/walking belt.

The above-described curved treadmill has the disadvantage that the user can only perform simple walking or running, hence a limited number of physical exercises.

Today, there is instead a strong need to be able to provide exercise machines, hence also treadmills, which are as versatile as possible, in a manner so as to ensure that a user can perform, even using only one exercise machine (hence with limited costs), the greatest possible number of physical exercises, even diversified from each other: in the cardiovascular field as well as in the muscular strength and force field.

SUMMARY OF THE INVENTION

The object of the present invention is to devise and provide a curved treadmill which allows at least partially overcoming the drawbacks lamented above with reference to the prior art, and in particular which is as versatile as possible in a manner so as to offer a user the possibility to carry out different types of physical exercises.

Such object is attained by a curved treadmill in accordance with claim 1.

Preferred embodiments of said curved treadmill are defined in the dependent claims.

BRIEF DESCRIPTION OF THE DRAWINGS

Further characteristics and advantages of the curved treadmill according to the invention will be clearer from the below-reported description of preferred embodiments, given as a non-limiting example with reference to the enclosed figures in which.

DETAILED DESCRIPTION OF THE PREFERRED EMBODIMENTS

With reference to the aforesaid figures, reference number 1 indicates a curved treadmill, herein below only treadmill, according to the invention in its entirety.

It should be noted that equivalent or similar elements in the figures will be indicated herein below with the same numeric or alphanumeric references.

Figure 1:
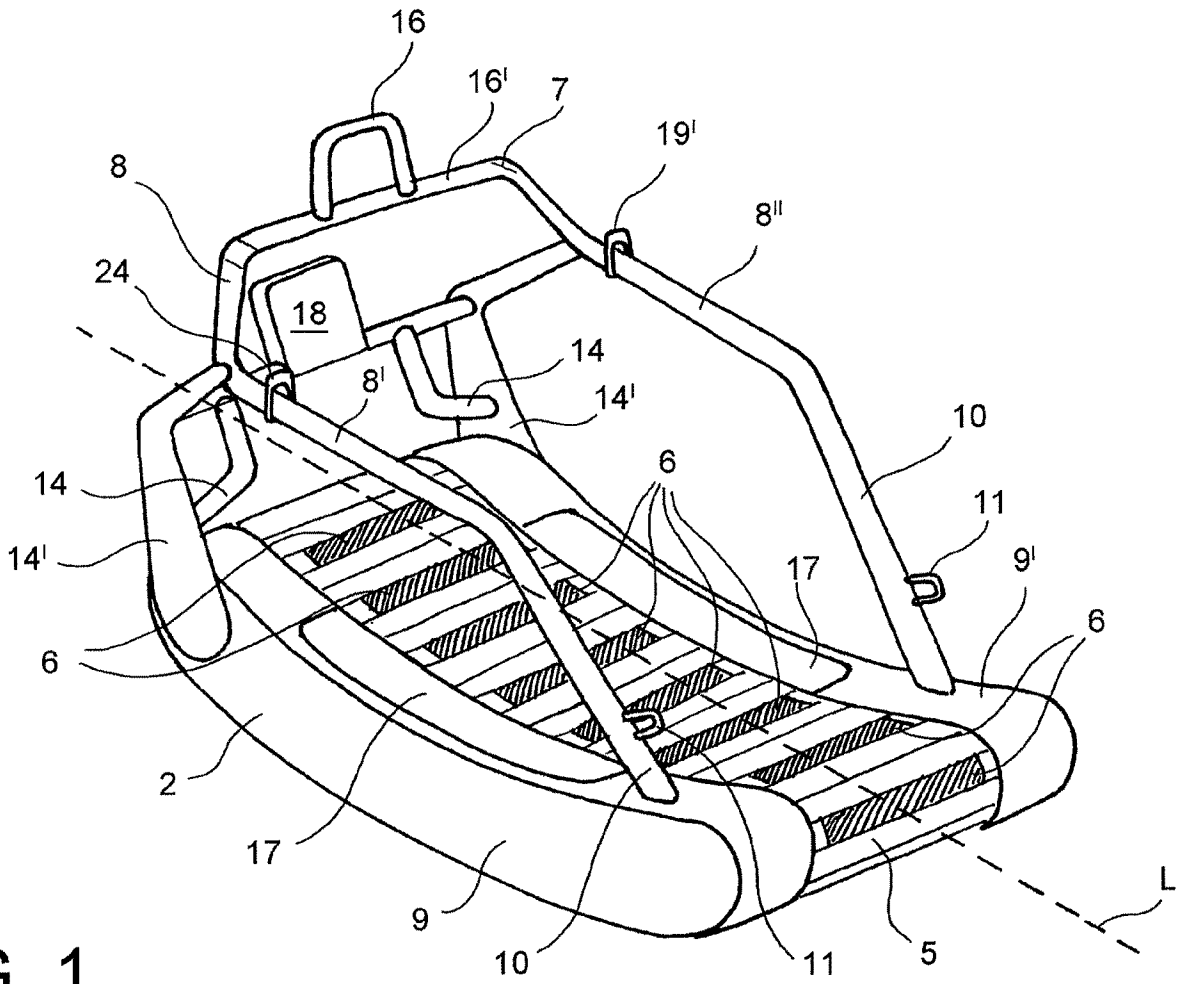
FIG. 1 illustrates a curved treadmill in accordance with one embodiment of the invention.
Figure 2:
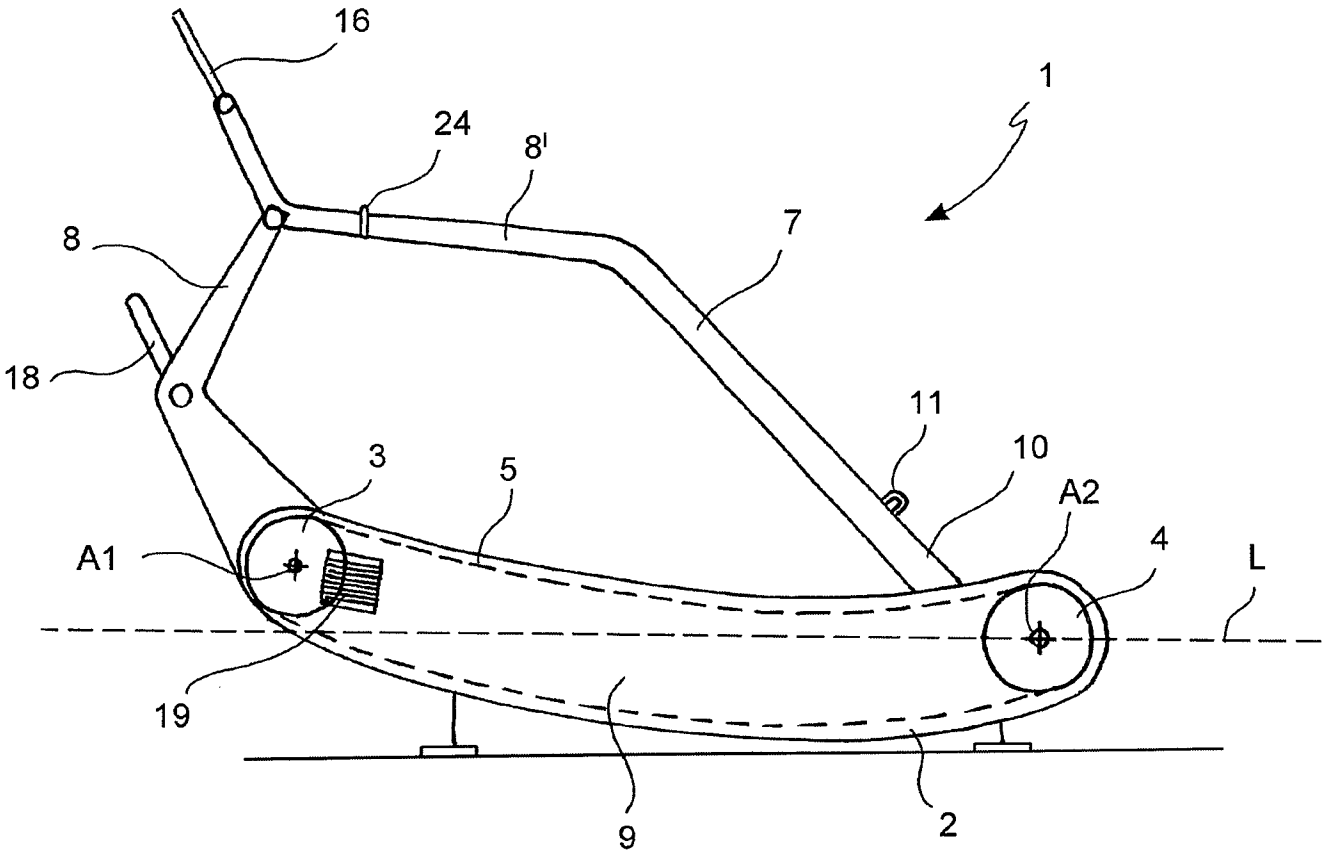
FIG. 2 illustrates a side section view of the curved treadmill of the FIG. 1.

In accordance with one embodiment, shown in FIGS. 1 and 2, the treadmill 1 comprises a base 2 extended along a longitudinal axis L, indicated in the figures with a dashed line.

The base 2 comprises a first roller 3 (shown in FIG. 2) adapted to rotate around a respective first rotation axis A1. The first rotation axis A1 is substantially transverse to the longitudinal axis L of the base 2 of the treadmill 1.

In addition, the base 2 comprises a second roller 4 (shown in FIG. 2) adapted to rotate around a respective second rotation axis A2. The second rotation axis A2 is substantially transverse to the longitudinal axis L of the base 2 of the treadmill 1. The second rotation axis A2 of the second roller 4 is substantially parallel to the first rotation axis A1 of the first roller 3.

It is observed that the first roller 3 is arranged at one end of the base 2 while the second roller 4 is arranged at a second end of the base 2, opposite said first end along the longitudinal axis L of the base 2.

The base 2 also comprises a physical exercise surface 5 operatively connected to the first roller 3 and to the second roller 4 in a manner such to have a lateral profile that is curved with respect to the longitudinal axis L of the base 2.

For the purpose of the present description, by physical exercise surface it is intended the rotatable surface of the treadmill directed upward, with respect to an abutment plane of the treadmill, on which, by abutting his feet or lower limbs in general, a user can perform a physical exercise such as, for example, running, walking or any other type of physical exercise which the curved treadmill 1 in accordance with the present invention advantageously allows performing.

Example of such physical exercises will be described herein below.

The physical exercise surface 5 is advantageously configured for rotating around the first roller 3 and the second roller 4, converting the potential energy of the user on the physical exercise surface 5 into rotational kinetic energy.

In more detail, the physical exercise surface 5 is mechanically constrained to the first roller 3 and to the second roller 4. The weight force exerted by the user on the physical exercise surface 5, in particular at the portion with greater curvature (for example, at the first roller 3), causes the rotation of the first roller 3 and the second roller 4, hence of the physical exercise surface 5 without the need to have a motor available in order to move the curved treadmill 1.

In one embodiment (shown in FIGS. 1 and 2), the physical exercise surface 5 comprises a plurality of strips transverse to the longitudinal axis L of the base 2. In other words, the physical exercise surface 5 has a rolling shutter configuration.

In accordance with another embodiment (not shown in the figures), the physical exercise surface 5 comprises a belt.

Still with reference to the embodiment of FIG. 1, the physical exercise surface 5 comprises a plurality of marking elements 6 distributed on the physical exercise surface 5 according to a set configuration.

In the embodiment in which the physical exercise surface 5 comprises a plurality of strips (rolling shutter) transverse to the longitudinal axis L of the base 2, the plurality of marking elements 6 is distributed on the plurality of strips according to a set configuration.

It is observed that the set configuration of the plurality of marking elements 6 allows advantageously indicating to the user where he should rest his feet during the execution of a type of physical exercise.

By way of example, as shown in FIG. 1, each marking element of the plurality of marking elements 6 can be a bar transverse to the longitudinal axis L of the base 2 represented with a color different from the rest of the physical exercise surface 5 or with a graphical pattern different from the rest of the physical exercise surface 5.

If the physical exercise is running on the curved treadmill 1, the plurality of marking elements 6 can be distributed in a manner such that each marking element, with respect to the longitudinal axis L of the base 2, is equidistant from adjacent elements. In this case, the hitting of the feet at the plurality of marking elements 6 advantageously allows the user to execute the running or walking with a set pace and/or stride width, conferring a precise spatial reference to the user along the longitudinal axis L.

It is indicated that, in one embodiment, the plurality of marking elements 6 can be fixed. Therefore, in this embodiment, if it is necessary to change the distribution of such marking elements, the physical exercise surface 5 should be entirely substituted.

In accordance with a further embodiment, an alternative to that described above, the plurality of marking elements 6 can comprise a plurality of panels adapted to be removably applied to the physical exercise surface 5, for example by means of coupling with screws or with fitted mounting.

Therefore, in this embodiment, if it is necessary to change the distribution of such marking elements (e.g. the distance between adjacent marking elements), it is possible to remove and apply all or some of the marking elements of the aforesaid plurality in different positions.

Returning to the embodiment of FIGS. 1 and 2, the curved treadmill 1 also comprises a frame 7 substantially extended in vertical direction with respect to the base 2.

The frame 7 is a combination of uprights and tubular elements that are operatively connected to each other and distributed in a manner such to define a support structure that substantially surrounds the user when the latter is situated on the physical exercise surface 5.

In more detail, in accordance with one embodiment (FIGS. 1 and 2), the frame 7 comprises a front portion 8 extended starting from the front end of the base 2, a first lateral portion 8' and a second lateral portion 8", connected to each other by means of the front portion 8, respectively extended from a first lateral portion 9 and from a second lateral portion 9' of the base 2.

It is indicated that the front portion 8, the first lateral portion 8' and the second lateral portion 8" of the frame 7 advantageously represent possible upper grips and/or abutment surfaces employable by the user for carrying out a physical exercise on the physical exercise surface 5 (for example, for supporting and maintaining equilibrium and correct posture during the physical exercise).

In other words, the front portion 8' represents a pair of upper handles employable by the user for carrying out a physical exercise, e.g. running or walking, on the physical exercise surface 5.

In addition, it is indicated that also the first lateral portion 8' and the second lateral portion 8" represent a pair of upper handles employable by the user for carrying out a physical exercise, for example running or walking, on the physical exercise surface 5.

In accordance with the embodiment of FIGS. 1 and 2, the frame 7 also comprises at least one upright 10 equipped with a connection 11 for a respective hook which the user possesses for carrying out an established physical exercise on the physical exercise surface 5 (for example, running with so-called haulage for muscular strengthening). Such hook can for example be the hook of a belt wearable by the user, the hook of a handle usable by the user for the physical exercise, or the hook coupled to a cord employable by the user for the physical exercise.

It is observed that in the embodiment of FIGS. 1 and 2, the frame 7 comprises a pair of uprights, both indicated with the reference number 10, each equipped with a connection 11 for a respective hook that the user possesses. Hook examples were defined in the preceding paragraph.

In accordance with another embodiment (not shown in the figures), the uprights of the frame 7 can lack connections. In such case, the hook which the user can possess for carrying out an established physical exercise on the physical exercise surface 5 can be coupled directly to the frame 7 or to the base 2.

In accordance with a further embodiment, as an alternative to or in combination with the above-described embodiments, the frame 7 of the curved treadmill 1 comprises at least one upright equipped with a second connection (not shown in the figures) for an elastic band employable by the user for carrying out a physical exercise on the physical exercise surface (for example, for performing muscular strengthening of the upper limbs or lower limbs).

In accordance with a further embodiment, an alternative to or in combination with one or more of the above-described embodiments, such second connection can be directly associated with the base 2.

In accordance with one embodiment, shown in FIGS. 1 and 2, the frame 7 also comprises at least one pair of lower handles 14 (only visible in FIG. 1) employable by the user for carrying out physical exercises on the physical exercise surface 5 (for example, for the support, the maintenance of equilibrium and the correct posture during the physical exercise).

It is observed that, as stated above, the physical exercise that the user can perform by employing the so-called upper handles (front portion 8, first lateral portion 8', second lateral portion 8") is, for example, the running or walking on the physical exercise surface 5.

Otherwise, the physical exercises that the user can perform by employing the pair of so-called lower handles 14 are, for example, muscular strengthening or pushing exercises in which the user assumes a position close to the physical exercise surface 5 which allows him to grip the pair of lower handles 14.

It is indicated that each lower handle can be constrained to the frame in a fixed or adjustable position, i.e. selectively lockable in multiple positions along the frame, in a manner so as to be advantageously adapted to the various anthropometric sizes of the users.

As shown in FIG. 1, the pair of lower handles 14 is arranged, for example, on two uprights 14' of the frame 7 extended in a substantially vertical direction with respect to the longitudinal axis L of the base 2, forming part of the front portion 8 of the frame 7. As can be observed, the pair of lower handles 14 is arranged, with respect to the so-called upper handles, closer to the physical exercise surface 5.

In addition, still with reference to the embodiment of FIGS. 1 and 2, the frame 7 can comprise a further handle 16, always employable by the user for performing a physical exercise on the physical exercise surface (for example, for the support and maintenance of the equilibrium or correct posture during the physical exercise).

Such further handle 16 is arranged on a transverse bar 16' of the frame 7, also forming part of the front portion 8 of the frame 7.

With reference to FIG. 1, in accordance with a further embodiment, as an alternative to or in combination with the above-described embodiments, the base 2 of the frame 7 comprises at least one portion 17 extended along the longitudinal axis L of the base 2 alongside the physical exercise surface 5.

Such at least one portion 17, during the execution of the physical exercise on the physical exercise surface 5, is fixed with respect to the physical exercise surface 5.

This advantageously allows performing a further type of physical exercises with the curved treadmill 1, that is those where it is provided to keep one foot still (generally lower limb) on said at least one portion 17 and to allow the movement of the other foot (generally lower limb) in contact with the physical exercise surface 5.

In other words, said at least one portion 17 of the base 2 represents a footboard, fixed with respect to the physical exercise surface 5, employable by the user for executing some types of physical exercises.

In accordance with one embodiment, it is observed that such at least one portion 17 of the base 2 can be arranged on one side of the base 2 or on the opposite side. In accordance with the embodiment of FIGS. 1 and 2, the frame 7 comprises a pair of portions 17, each of which arranged on one side of the base 2 in a manner so as to be alongside the physical exercise surface 5.

Returning once again to the embodiment of FIGS. 1 and 2, the curved treadmill 1 also comprises a display 18 operatively connected to the frame 7 at the front portion 8.

In an alternative embodiment, the display 18 can be operatively connected to the frame 7 at the further handle 16.

In other embodiments, not shown in the figures, the curved treadmill 1 may lack the display 18.

Once again with reference to the embodiment of FIGS. 1 and 2, the curved treadmill 1 also comprises at least one brake device 19 (schematically illustrated in FIG. 2) operatively connected to the first roller 3. Such at least one brake device 19 is configured for exerting a braking action on the first roller 3.

Several modes with which the brake device 19 is operatively connected to the first roller 3, in order to exert the braking action thereon, will be described herein below with reference to the embodiments illustrated in FIGS. 3, 4 and 5.

Brake device 19 examples include: brake of electromagnetic type; brake of pad type; brake of permanent magnet type; brake of air or other fluid type.

With reference to the embodiment of FIGS. 1 and 2, the curved treadmill 1 also comprises a first control device 19' (visible in FIG. 1) of the brake device 19. The first control device 19', mounted on the frame 7 in a position accessible to the user, is operatively connected to the brake device 19 and is configured for adjusting the brake device 19 in order to exert the braking action on the first roller 3.

Figure 3:
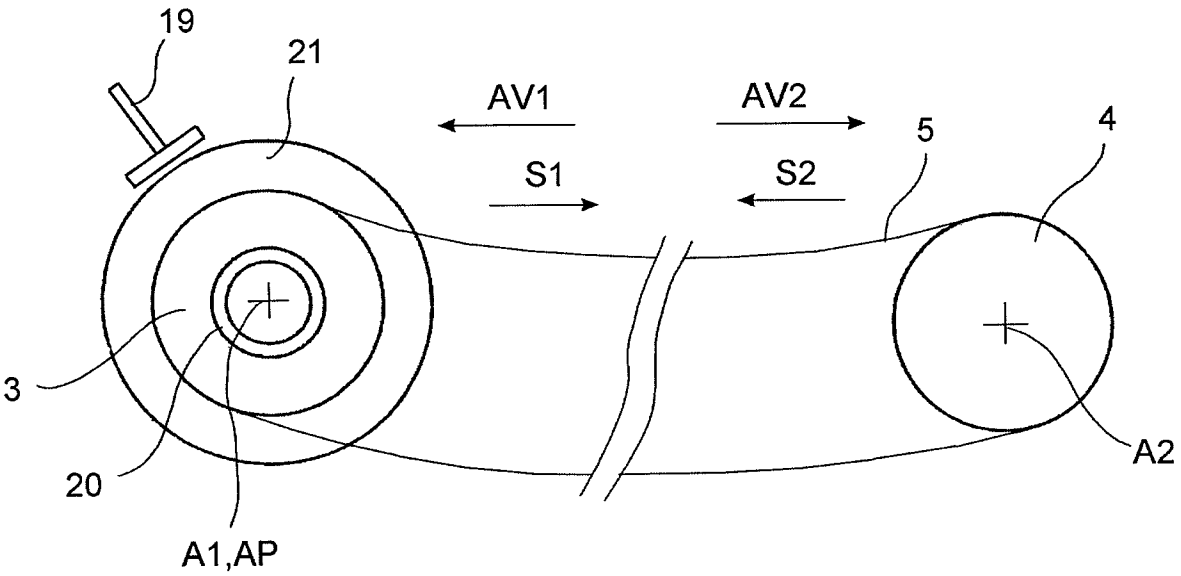
FIG. 3 schematically shows a side section view of a configuration of several elements of a curved treadmill according to one embodiment of the invention.
Figure 4:
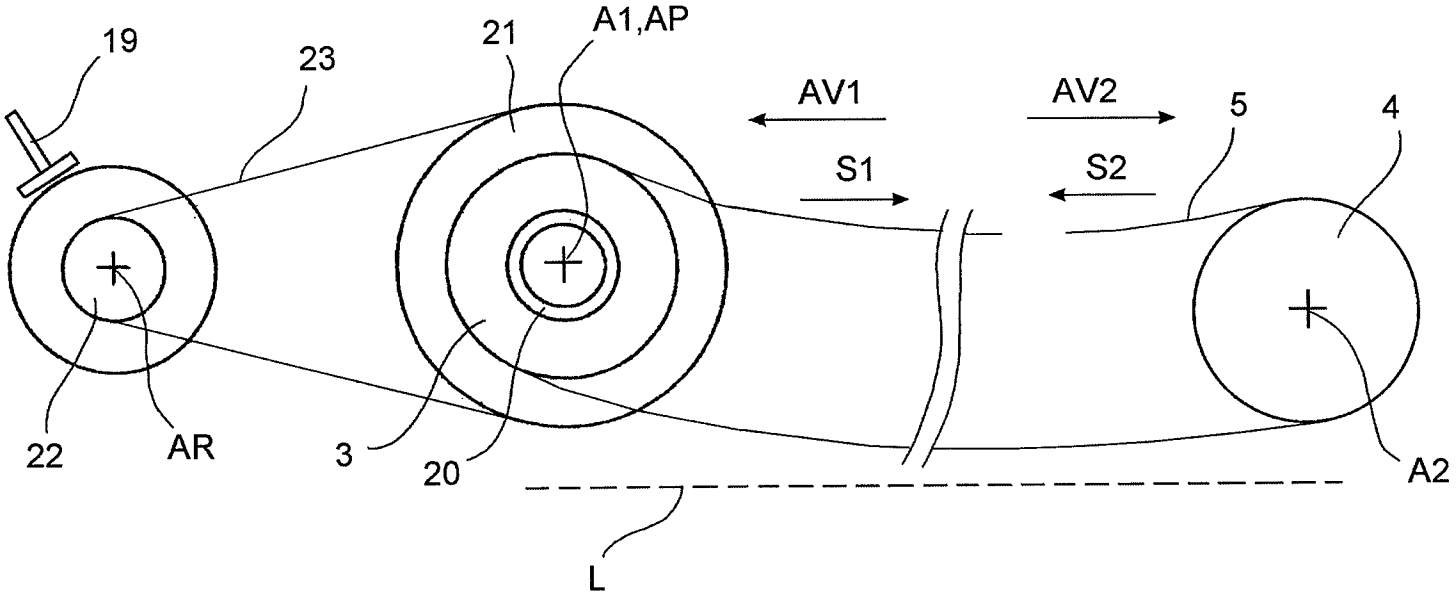
FIG. 4 schematically shows a side section view of a configuration of several elements of a curved treadmill according to a further embodiment of the invention, FIG. 5 schematically illustrates a side section view of a configuration of several elements of a curved treadmill according to a further embodiment of the invention.
Figure 5:
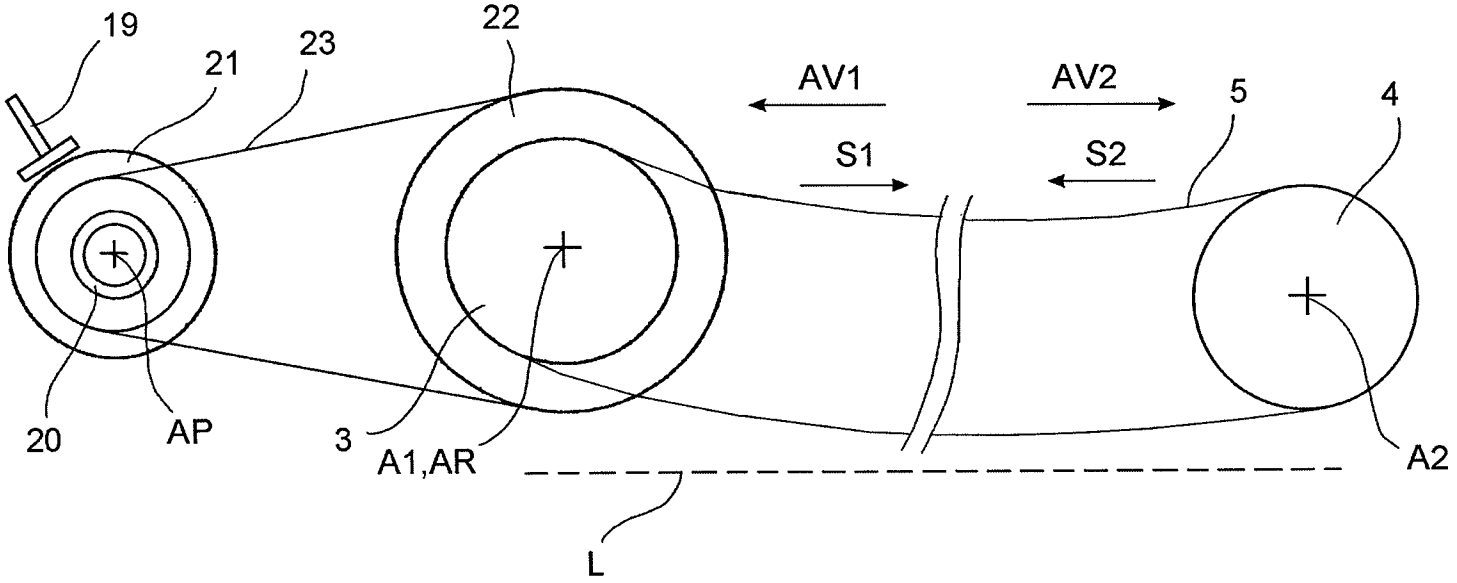

Returning to the base 2 of the curved treadmill 1, generally with reference to the embodiments of FIGS. 3, 4 and 5, it comprises a first pulley 21 operatively connected to the first roller 3.

The first pulley 21 is adapted to rotate around a respective rotation axis AP.

The brake device 19 is configured for exerting a braking action on the first pulley 21. In other words, as already indicated above, the brake device 19 is configured for exerting a braking action on the first roller 3 by exerting the braking action on the first pulley 21 operatively connected to the first roller 3.

Still with reference to the embodiments of FIGS. 3, 4 and 5, the base 2 advantageously comprises a first coupling device 20 operatively connected between the first roller 3 and the first pulley 21.

Different operative connection configurations of the first coupling device 20 are described herein below, each corresponding to one of the embodiments as separately illustrated in FIGS. 3, 4 and 5.

Returning once again generally to the embodiments of FIGS. 3, 4 and 5, the first coupling device 20, during the rotation of the physical exercise surface 5 in a first rotation sense S1 (indicated with an arrow in FIGS. 3, 4 and 5) along the longitudinal axis L of the base 2, is configured for advantageously allowing the integral rotation of the first pulley 21 and of the first roller 3 around the respective rotation axis AP, A1 if the rotation speed of the first roller 3 is greater than or equal to the rotation speed of the first pulley 21.

It is observed that the first rotation sense S1 of the physical exercise surface 5, for example from the first roller 3 to the second roller 4, is obtained with the interaction of the user with the physical exercise surface 5 in a first opposite advancement sense av1 along the longitudinal axis L of the base 2 (from right to left with reference to the section view of FIGS. 3, 4 and 5).

During a walk or run on the exercise surface 5 in the first rotation sense S1, if the user maintains or increases the run or walk speed along the first advancement sense av1, the first coupling device 20 is adapted to allow the transmission of the motion from the first roller 3 (drive member) to the first pulley 21 (driven member).

This is possible since the first coupling device 20 is, for example, a mechanism of free wheel type inserted between a drive member (first roller 3) and driven member (first pulley 21).

The mechanism of free wheel type allows the integral rotation of the driven member (first pulley 21) and the drive member (first roller 3), allowing the braking action of the brake device 19 on the latter, in the first rotation sense S1 of the physical exercise surface 5, only if the rotation speed of the drive member is greater than or equal to the speed of the driven member. This is possible since the mechanism of free wheel type is engaged in abutment only at the above-indicated speed conditions, as well as in only one rotation sense (in the above-illustrated example, the first rotation sense S1 of the physical exercise surface 5).

For such purpose, in one embodiment in which the base 2 of the curved treadmill 1 comprises a flywheel mass (or simply flywheel) operatively connected to the first pulley 21 or represented by the same mass of the first pulley 21, the first coupling device 20—when the user maintains or increases the running or walking speed (acceleration) in the first rotation sense S1 of the exercise surface 5—advantageously allows coupling the flywheel mass, or the first pulley 21 (if the latter represents the flywheel mass), with the first roller 3. In such a manner, it is possible for the user to adjust his own speed imparted on the physical exercise surface 5, hence on the first roller 3, advantageously obtaining a more comfortable execution of the physical exercise.

With reference to the mechanism of free wheel type, in a first embodiment, this can be a first internal ring and a second external ring, between which the mechanism of free wheel type (e.g. a plurality of bearings) is interposed, configured for being engaged in abutment only if the rotation speed of the drive member (first roller 3) is equal to or greater than that of the driven member (first pulley 21), thus transferring the rotary motion from the drive member to the driven member. On the contrary, if the rotation speed of the drive member is lower than that of the driven member, the free wheel mechanism is configured for freely rotating without transferring any rotary motion from the drive member to the driven member.

It is indicated that the first coupling device 20 can be coupled to a rotating shaft (not shown in FIGS. 1-5) integral with the first roller 3, for example by means of a tongue coupling between the first internal ring and a respective seat obtained on the rotating shaft itself.

According to a further embodiment, the first coupling device 20 comprises a mechanism of free wheel type which is engaged in abutment directly on the rotating shaft of the first roller 3. In such case, the mechanism of free wheel type is configured for being engaged in abutment against the rotating shaft of the first roller 3, transferring the rotary motion from the drive member to the driven member, in the same above-described conditions of rotation speed of the drive member, with respect to the rotation speed of the driven member.

Returning to the embodiments of FIGS. 3, 4 and 5, the first coupling device 20, during the rotation of the physical exercise surface 5 in the first rotation sense S1 along the longitudinal axis L of the base 2, is advantageously configured for preventing the integral rotation of the first pulley 21 and of the first roller 3 around the respective rotation axis AP, A1 if the rotation speed of the first roller 3 is lower than the rotation speed of the first pulley 21.

Indeed, during a walk or run on the exercise surface 5, if the user reduces the running or walking speed along the first advancement sense av1, corresponding to and opposite the first rotation sense S1 of the physical exercise surface 5, the first coupling device 20 is adapted to prevent the transmission of the motion from the first roller 3 (drive member) to the first pulley 21 (driven member).

This is possible since the first coupling device 20 is, for example, as stated above, a mechanism of free wheel type inserted between a drive member (first roller 3) and a driven member (first pulley 21).

The mechanism of free wheel type prevents the integral rotation of the driven member (first pulley 21) and of the drive member (first roller 3), preventing the braking action of the brake device 19 on the latter, in the first rotation sense S1 of the physical exercise surface 5, only if the rotation speed of the drive member is lower than the speed of the driven member. This is possible since the mechanism of free wheel type is engaged in abutment only at the above-indicated speed conditions, as well as in only one rotation sense (in the above-illustrated embodiment, the first rotation sense S1 of the physical exercise surface 5).

It is noted that in the embodiment where the base 2 of the curved treadmill 1 comprises a flywheel mass operatively connected to the first pulley 21 (or represented by the same mass of the first pulley 21), the first coupling device 20—when the user decreases the running or walking speed (deceleration) in the first rotation sense S1 of the exercise surface 5—allows uncoupling the flywheel mass (or the first pulley 21, if the latter represents the flywheel mass) from the first roller 3. This advantageously prevents the user from feeling on his legs the effect of the inertia of the flywheel mass and of other moving masses, which during deceleration could lead to the dragging of the user himself by the physical exercise surface 5, hence to a possible fall of the user.

Returning once again to the embodiments of FIGS. 3, 4 and 5, the first coupling device 20 is configured for preventing the exercise of the braking action of the brake device 19 on the first roller 3 during the rotation of the physical exercise surface 5 in a second rotation sense S2 along the longitudinal axis L of the base 2, opposite the first rotation sense S1 of the physical exercise surface.

It is observed that the second rotation sense S2 of the physical exercise surface 5, for example from the second roller 4 to the first roller 3, is obtained with the interaction of the user with the physical exercise surface 5 in a second opposite advancement sense av2 along the longitudinal axis L of the base 2 (from left to right with reference to the section view of FIGS. 3, 4 and 5).

That described above advantageously allows the user to perform a first physical exercise (e.g. a run or a walk) on the curved treadmill 1 in the first advancement sense av1 with the physical exercise surface 5 subjected to the braking action exerted by the brake device 19 on the first roller 3, and a second physical exercise (e.g. a run or a walk) in the second advancement sense av2 with the physical exercise surface 5 not subjected to the braking action exerted by the brake device 19 on the first roller 3.

In other words, the physical exercise surface 5 can rotate in both rotation senses S1 and S2 but in the first rotation sense S1 (in which it is subjected to the braking action) it allows a braked run or walk while in the second rotation sense S2 it allows a free run or walk.

Still with reference to the embodiments of FIGS. 3, 4 and 5, the brake device 19 is operatively connected to the first roller 3, in order to exert the braking action thereon, by means of the first pulley 21 and the first coupling device 20.

The first coupling device 20 is configured for preventing the integral rotation of the first pulley 21 and the first roller 3 around the respective rotation axis AP, A1 during the rotation of the physical exercise surface 5 in the second rotation sense S2 along the longitudinal axis L of the base 2

(i.e. when the user proceeds in the second advancement sense av2), rendering the first roller 3 and the first pulley 21 freely rotatable.

In other words, the physical exercise surface 5 can only rotate in one rotation sense (for example, in the first rotation sense S1), allowing a braked run or walk.

This is possible since the first coupling device 20 is, for example, as stated above, a mechanism of free wheel type inserted between a drive member (first roller 3) and a driven member (first pulley 21).

The mechanism of free wheel type in fact allows the rotation of the driven member (first pulley 21) together with the drive member (first roller 3), obtaining the braking action of the brake device 19 on the latter only in one rotation sense (first rotation sense S1 of the physical exercise surface 5) and only if the rotation speed of the drive member is equal to or greater than the rotation speed of the driven member. This is possible since the mechanism of free wheel type is engaged in abutment only in one rotation sense and at the speed conditions indicated above.

On the contrary, the mechanism of free wheel type does not allow the rotation of the driven member (first pulley 21) together with the drive member (first roller 3), preventing the braking action of the brake device 19 on the latter, only in the opposite rotation sense (second rotation sense S2 of the physical exercise surface 5). This is possible since the mechanism of free wheel type does not engage in abutment in the rotation sense opposite that where the engagement in abutment is obtained. Examples of free wheel mechanisms of known type were described above.

With particular reference to the embodiment of the FIG. 3, it is indicated that the first roller 3, the first pulley 21 and the first coupling device 20 are arranged in a manner so as to have the same rotation axis, i.e. the first rotation axis A1 (coinciding with the rotation axis of the first pulley AP). The brake device 19 is adapted to exert the braking action directly on the first pulley 21.

With reference now to the embodiment of the FIG. 4, the base 2 also comprises a second pulley 22 operatively connected to the first pulley 21 by means of a drive belt 23.

The second pulley 22 is adapted to rotate around a respective rotation axis AR parallel to the first rotation axis A1 of the first roller 3 and to the respective rotation axis AP of the first pulley 21.

The first coupling device 20, e.g. a mechanism of free wheel type, the first roller 3 and the first pulley 21 are arranged so as to have the same rotation axis, i.e. the first rotation axis A1 (or the respective rotation axis AP of the first pulley 21).

In this embodiment, the brake device 19 is adapted to exert the braking action directly on the second pulley 22. Such braking action is indirectly transmitted to the first pulley 21 by means of the drive belt 23.

In this embodiment, the effect of the mechanism of free wheel type (first coupling device 20) is exerted between the first pulley 21 (driven member) and the first roller 3 (drive member), as described above.

With reference now to FIG. 5, in accordance with a further embodiment, an alternative to the embodiments described above with reference to FIGS. 3 and 4, the base 2 comprises a second pulley 22 integral with the first roller 3.

The second pulley 22 and the first roller 3 therefore have the same rotation axis, i.e. the first rotation axis A1 (AR).

The second pulley 22 is operatively connected to the first pulley 21 by means of a drive belt 23.

The first pulley 21 is adapted to rotate around the respective rotation axis AP which, in this embodiment, is parallel to but not coinciding with the first rotation axis A1 of the first roller 3 and of the second pulley 22.

Also the first coupling device 20, e.g. a mechanism of free wheel type, is adapted to rotate around the respective rotation axis AP of the first pulley 21.

In this embodiment, the effect of the mechanism of free wheel type (first coupling device 20) is exerted between the first pulley 21 (driven member) and the first roller 3 (drive member), by means of the drive belt 23 adapted to transfer the rotation of the second pulley 22 (integral with the first roller 3) to the first pulley 21.

In this embodiment, the brake device 19 is configured for exerting a braking action directly on the first pulley 21.

In other words, the brake device 19 is operatively connected to the first roller 3, in order to exert the braking action thereon, by means of the first pulley 21, the first coupling device 20, the drive belt 23 and the second pulley 22.

Returning generally to the curved treadmill 1, with reference to the embodiments of FIGS. 6 and 7 (described herein below), as an alternative to or in combination with the above-described embodiments, the base 2 is advantageously configured for allowing the physical exercise surface 5 to assume a one-way rotation mode along the longitudinal axis L of the base 2. This signifies that the physical exercise surface 5 is capable of rotating in only one rotation sense along the longitudinal axis L of the base 2 (for example, the first rotation sense S1). In addition, the base 2 is advantageously configured for allowing the physical exercise surface 5 to assume a two-way rotation mode along the longitudinal axis L of the base 2. This signifies that the physical exercise surface 5 is capable of rotating, along the longitudinal axis L of the base 2, both in the first rotation sense S1 and in the second rotation sense S2.

This advantageously allows increasing the number of physical exercises that a user can perform on the belt 1, as will be stated herein below.

Figure 6:
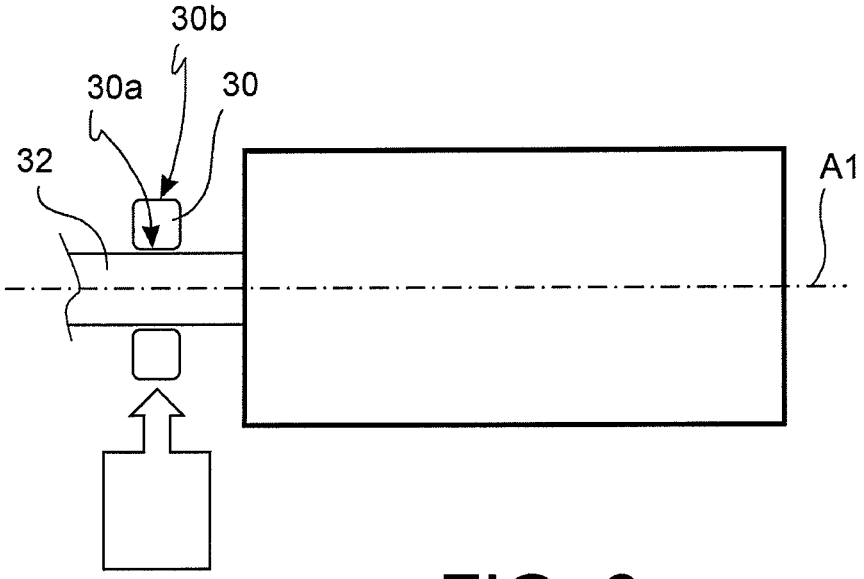
FIG. 6 schematically illustrates a section view of a configuration of several elements of a curved treadmill according to one embodiment of the invention, and FIG. 7 schematically illustrates a section view of a configuration of several elements of a curved treadmill according to a further embodiment of the invention.

With particular reference to FIG. 6, it is indicated that the base 2, according to a further embodiment, comprises a second coupling device 30 operatively associated with the first roller 3.

The second coupling device 30 is adapted to rotate around the first rotation axis A1 of the first roller 3, as is schematically illustrated in FIG. 6.

In particular, the second coupling device 30 is operatively associated with a rotating shaft 32, integral with the first roller 3.

In more detail, the second coupling device 30 comprises a mechanism of free wheel type operatively associated with the rotating shaft 32 at an internal surface 30*a* of the second coupling device 30, facing the rotating shaft 32.

For example, the second coupling device 30 can be a mechanism of free wheel type that comprises a first internal ring and a second external ring between which the mechanism of free wheel type (for example, a plurality of bearings) is interposed that is engaged in abutment in only one rotation sense (for example, the first rotation sense S1). In such rotation sense, the mechanism of free wheel type is configured for preventing the relative rotation between the first internal ring and the second external ring, while in the opposite sense (for example, the second rotation sense S2), the mechanism of free wheel type is not engaged in abutment, so that it is configured for allowing the relative rotation between the first external ring and internal ring, which are freely rotatable with respect to each other.

In this case, the second coupling device 30 can be coupled to the rotating shaft 32 integral with the first roller 3, for example by means of a tongue coupling between the first internal ring and a respective seat obtained on the rotating shaft 32 (not represented in the figure).

According to a further embodiment, the second coupling device 30 comprises a mechanism of free wheel type that is engaged in abutment directly against the rotating shaft 32.

In this case, the mechanism of free wheel type is not coupled to the rotating shaft 32 in a rigid manner, as in the previous example, but in a selectively rotatable manner.

In particular, in a rotation sense (e.g. the first rotation sense S1), the mechanism of free wheel type is engaged in abutment against the rotating shaft 32, making the second coupling device 30 integral with the rotating shaft 32 itself, hence with the first roller 3, while, in the opposite rotation sense (e.g. the second rotation sense S2), the mechanism of free wheel type is not engaged in abutment against the rotating shaft 32, making the second coupling device 30 freely rotatable with respect to the rotating shaft 32 itself, hence to the first roller 3.

Returning once again to the embodiment of FIG. 6, the base 2 also comprises a constraining device 31 (schematically shown in FIG. 6), associated with the base 2, configured for selectively constraining the second coupling device 30 to the base 2 (not shown in the FIG. 6).

Indeed, the constraining device 31 comprises a fixed portion (schematically shown with a rectangle in FIG. 6), integral with the base 2, and a portion that is movable with respect to the fixed portion. The movable portion is schematically shown with an arrow in FIG. 6. The movable portion is configured for engaging/disengaging with the second coupling device 30, selectively constraining the second coupling device 30 to the base 2, i.e. making it integral therewith in order to prevent any relative movement thereof with respect to the base 2.

In particular, the constraining device 31 is configured for selectively constraining the second coupling device 30 to the base 2, at an external surface 30*b* of the second coupling device 30, opposite the internal surface 30*a*, as will be described herein below.

By way of example, the constraining device 31 comprises, as a second portion that is movable with respect to the first portion, a thrust element configured for assuming two possible operative configurations with respect to the second coupling device 30.

In a first operative configuration, the thrust element is engaged with the second coupling device 30 at the external surface 30*b*, blocking the rotation of the external surface 30*b* of the second coupling device 30, by constraining the latter to the base 2.

In a second configuration, the thrust element is not engaged with the second coupling device 30 at the external surface 30*b*, unblocking the rotation of the external surface 30*b* of the second coupling device 30, which is no longer constrained to the base 2.

At the functional level, when the constraining device 31 is in the condition of constraining the second coupling device 30 to the base 2, the second coupling device 30 is configured for allowing the rotation of the physical exercise surface 5 in the first rotation sense S1 along the longitudinal axis L of the base 2 and is configured for preventing the rotation of the physical exercise surface 5 in the second rotation sense S2 along the longitudinal axis of the base 2.

When instead the constraining device 31 is in the condition of not constraining the second coupling device 30 to the base 2, the second coupling device 30 is configured for allowing the rotation of the physical exercise surface 5 both in the first rotation sense S1 and in the second rotation sense S2.

This advantageously allows making the curved treadmill 1 more versatile since, in one case, when the constraining device 31 is in the condition of constraining the second coupling device 30 to the base 2, the physical exercise surface 5 can only rotate in one rotation sense, giving the user the possibility to perform several physical exercises on the curved treadmill 1. Instead, if the constraining device 31 is in the condition of not constraining the second coupling device 30 to the base 2, the physical exercise surface 5 can rotate in both senses, giving the user the possibility to perform other physical exercises on the curved treadmill 1.

Figure 7:
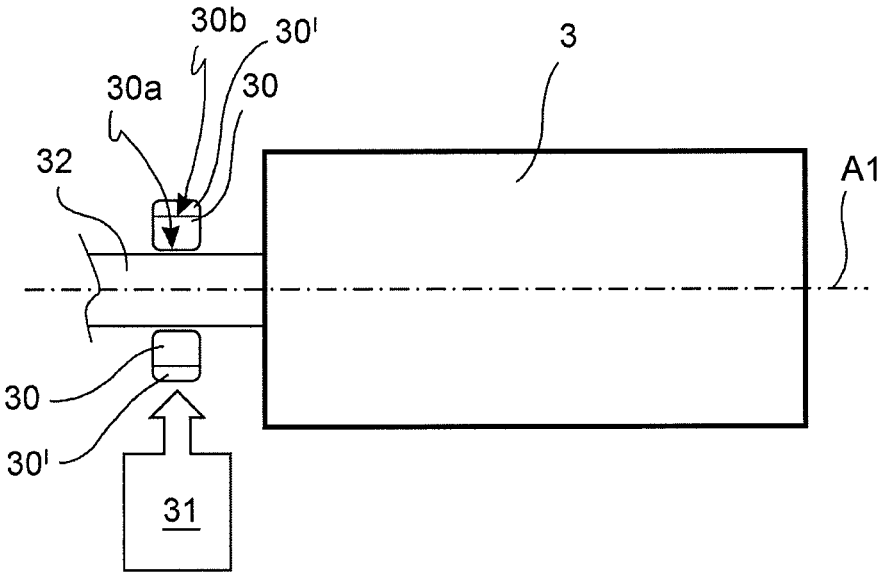

According to a further embodiment shown in FIG. 7, an alternative to the embodiments described above, the base 2 comprises a third pulley 30' operatively connected to the first roller 3. The third pulley 30' is adapted to rotate around the first rotation axis A1 of the first roller 3.

In this embodiment, the second coupling device 30 is operatively associated between the third pulley 30' and the first roller 3. The second coupling device 30 is adapted to rotate around the first rotation axis A1 of the first roller 3.

In more detail, as shown in FIG. 7, the third pulley 30' can be operatively associated (for example, by means of a forced shaft/hub coupling) with the second coupling device 30 at the external surface 30*b* of the second coupling device 30.

In this embodiment, the constraining device 31 is configured for selectively constraining the third pulley 30' with respect to the base 2, in a manner entirely analogous to that described above with reference to the direct action of the constraining device 31 on the second coupling device 30 (embodiment of FIG. 6).

At the functional level, when the third pulley 30' is constrained to the base 2, the second coupling device 30 allows obtaining a one-way physical exercise surface, i.e. capable of rotating only in one rotation sense with respect to the base 2.

When the third pulley 30' is not constrained to the base 2, the second coupling device 30 does not exert any function, allowing the obtainment of a physical exercise surface 5 of two-way type, i.e. capable of rotating both in the first rotation sense S1, and in the second rotation sense S2.

With regard once again, generally, to the constraining device 31, in accordance with one embodiment, this is configured for constraining the second coupling device 30 (or the third pulley 30', if present), with respect to the base 2, by means of shape coupling.

For example, the shape coupling can be obtained by means of the use of an irregular profile, e.g. toothed, obtained on the external surface 30*b* of the second coupling device 30 (or of the external surface of the third pulley 30') and one end, or a profile of said end having profile complementary to that obtained on the external surface 30*b* of the second coupling device 30 (or of the external surface of the third pulley 30'), of the thrust element (movable portion), described above, of the second coupling device 30.

In accordance with a further embodiment, the constraining device 31 is configured for selectively constraining the second coupling device 30 (or the third pulley 30', if present), with respect to the base 2, by means of friction coupling (pad).

It is also observed that, in the embodiments schematically represented in FIGS. 6 and 7, the constraining device 31 is configured for acting on the second coupling device 30 (or on the third pulley 30') in axial sense.

In accordance with another embodiment, the constraining device 31 is configured for acting on the second coupling device 30 in radial sense, producing, with a different mechanical configuration, the same effects produced by the mechanical configuration schematically illustrated in FIGS. 6 and 7.

Returning now also to FIG. 1, it is observed that the curved treadmill 1 also comprises a second control device 24, e.g. a lever, of the constraining device 31.

The second control device 24 is preferably mounted on the frame 7 in a position accessible by the user also during the use of the curved treadmill 1.

The second control device 24 advantageously allows the user to be able to manually selectively constrain the second coupling device 30 (or the third pulley 30', if present) to the base 2, thus selecting the rotation type of the physical exercise surface 5: one-way or two-way.

It is indicated that that described up to now makes reference to the embodiments, illustrated in FIGS. 6 and 7, in which the second coupling device 30 is operatively associated with the first roller 3 of the base 2 of the treadmill 1.

Nevertheless, according to another embodiment (not shown in the figures), alternatively, the second coupling device 30 can be operatively associated with the second roller 4 of the base 2 of the treadmill 1.

In accordance with a further embodiment (not shown in the figures), an alternative to the embodiments described above, the base 2 of the treadmill 1 may lack the first coupling device 20. In such embodiment, the base 2 of the treadmill 1 comprises the constraining device 31, the second coupling device 30 arranged according to any one above-described configuration and configured in a manner entirely analogous to the same elements described above with particular reference to the embodiments of FIGS. 6, 7 and following.

With reference once again to FIGS. 1 and 2 and to the embodiment of FIG. 3, an example of operation of the curved treadmill 1 is now described.

The user climbs on the physical exercise surface 5.

The second control device 24 of the constraining device 31 of the second coupling device 30 is for example driven by the user such that the second coupling device 30 does not act on the first roller 3.

Therefore, the physical exercise surface 5 can rotate both in the first rotation sense S1 and in the second rotation sense S2 (physical exercise surface 5 of two-way type).

The user can carry out various physical exercises on the physical exercise surface 5 adapted to rotate in both rotation senses.

For example, the user, by gripping the pair of lower handles 14 and advancing in the first advancement sense av1, rotates the physical exercise surface 5 in the first rotation sense S1 in order to perform muscular strengthening exercises for the lower limbs. In this case, it is observed that the first roller 3 and the second roller 4, hence the physical exercise surface 5, are rotated by the action of the weight force of the user and by the pushing force of the user exerted during the execution of physical muscular strengthening exercises.

Alternatively, the user, for example, by gripping the upper handles (the front portion 8 or the first lateral portion 8' and the second lateral portion 8"), rotates the physical exercise surface 5 in the first rotation sense S1 in order to exert physical exercises such as running or walking. In this case, the first roller 3 and the second roller 4, hence the physical exercise surface 5, are rotated by the action of the weight force of the user.

In both of the described physical exercises (muscular strengthening and running/walking), if the user maintains or increases the physical exercise speed, such that the rotation speed of the first roller 3 is equal to the rotation speed of the first pulley 21, the physical exercise surface 5 is under the action of the brake device 19, increasing the effort required by the user to perform the physical exercise in a regular manner on the physical exercise surface 5.

In addition, by gripping the lower handles 14 or the upper handles 8, 8', 8", the user could put his feet together and push, first in the first advancement sense av1 towards the front part of the base 2, exploiting the effect of the braking action of the brake device 19 on the first roller 3, then in the second advancement sense av2, moving away from the front part of the base 2, without feeling any braking action on the physical exercise surface 5.

The same physical muscular strengthening exercise could be executed by resting one of the feet on the portion 19 of the base 2. In this case, the muscular strengthening would be mainly obtained on the other lower limb rested on the physical exercise surface 5.

The user can also not grip the pair of upper handles 8, 8, 8" in order to simply execute a run or walk in the first advancement sense av1.

In this case, by acting on the first control device 19' of the brake device 19, the braking action on the first roller 3 can be adjusted, thus obtaining a different resistance that the user must overcome on the physical exercise surface 5 during the run or walk.

Instead, the user can execute a run or walk in the second advancement sense av2. In this case, the physical exercise surface 5 is not subjected to any braking action by the brake device 19.

Other exercises that can be executed with the physical exercise surface 5 rotating in both rotation senses are, for example, running or walking with haulage, in which the user connects a belt to the hook 11 present on the upright 10 of the frame 7, or muscular strengthening exercises in which the user connects an elastic bend to another hook arranged on another upright of the frame 7.

In addition to the physical exercises in which the user is directed parallel to the longitudinal axis L of the base 2 (e.g. running or walking) or other exercises of muscular strengthening or elongation, the physical exercise surface 5 can be employed for executing physical exercises in which the user is directed transverse to the longitudinal axis L of the base 2.

For example, by gripping the first lateral portion 8' (or the second lateral portion 8") of the frame 7, the user can move the physical exercise surface 5 in a manner so as to obtain an oscillating effect along the longitudinal axis L of the base 2.

Instead, by driving second control device 24, the user can allow the interaction of the second coupling device 30 on the first roller 3.

In this manner, the physical exercise surface 5 passes from a two-way mode, in which it can rotate in both rotation senses, to a one-way mode, in which it can only rotate in one rotation sense, e.g. in the first rotation sense S1.

In this configuration, it is possible to once again perform the same physical exercises described above, which already provided for the rotation of the physical exercise surface 5 in one rotation sense, but in improved safety conditions, since the rotation of the physical exercise surface in the opposite sense is not provided for.

As can be observed, the object of the invention is attained since the described curved treadmill 1, due to the presence of the first coupling device 20 between the first roller 3 and the first pulley 21, advantageously allows providing a physical exercise surface 5 adapted to perform different physical exercises if it is rotated in the first rotation sense S1, in which the transfer of the rotary motion between the first roller 3 and the first pulley 21 can occur, exerting a resistance for the user, also increased by the braking action, or in which the transfer of the rotary motion between the first roller 3 and the first pulley 21 cannot occur, therefore not exerting any resistance for the user, not even the braking action.

In addition, the constraining device 31 of the second coupling device 30 advantageously allows passing from a mode in which the physical exercise surface 5 rotates in both senses to a mode in which the physical exercise surface 5 rotates in only one sense, thus being safer.

In addition, the possibility of adjusting the braking action advantageously allows executing various exercises in which the resistance to overcome is different and selectable in accordance with the type of training to be performed.

Once again, the presence of handles and hooks as described above allows the curved treadmill 1 to be employed for also carrying out other physical exercises with haulage, elastic band, and so forth.

In addition, as also stated above, the possibility to enable/disable the flywheel connectable to the first roller 3 allows once again increasing the safety of the physical exercise surface 5, generally of the curved treadmill 1.

Finally, the presence of the plurality of marking elements 6, also removable, on the physical exercise surface 5 allow indicating to the user—during the run or walk—the regular pace to be maintained.

With regard to the above-described embodiments of the curved treadmill, in order to meet contingent needs, a man skilled in the art can make changes, adaptations and substitutions of elements with other functionally equivalent elements, without departing from the scope of the following claims. Each of the characteristics described as belonging to a possible embodiment can be obtained independent of the other described embodiments.

What is claimed is:

1. A motor-less curved treadmill comprising:

a base extended along a longitudinal axis, the base comprising:

a first roller adapted to rotate around a respective first rotation axis, the first rotation axis being substantially transverse to the longitudinal axis of the base;

a second roller adapted to rotate around a respective second rotation axis, the second rotation axis being substantially transverse to the longitudinal axis of the base;

a physical exercise surface operatively connected to the first roller and to the second roller in a manner such to have a lateral profile that is curved with respect to the longitudinal axis of the base, the physical exercise surface being configured to rotate around the first roller and the second roller, converting the potential energy of the user on the physical exercise surface into rotational kinetic energy;

a first pulley operatively connected to the first roller, the first pulley being adapted to rotate around a respective rotation axis, wherein the base also comprises a free wheel mechanism operatively connected between the first roller and the first pulley, such that, during a walk or run on the physical exercise surface in a first rotational direction, if the user maintains or increases the run or walk speed along a first advancement sense, the free wheel mechanism is engaged, allowing the transmission of rotary motion from the first roller to the first pulley, during a walk or run on the physical exercise surface, if the user reduces the running or walking speed along the first advancement sense, corresponding to and opposite the first rotational direction of the physical exercise surface, the free wheel mechanism is disengaged, preventing the transmission of the motion from the first roller to the first pulley;

wherein the base further comprises at least one brake device connected to the first pulley, the brake device being configured to exert a braking action on the first pulley, the free wheel mechanism engaging the first pulley with the first roller and allowing the braking action of the brake device to be transmitted to the first roller during the rotation of the physical exercise surface in the first rotational direction only if, during a walk or run on the physical exercise surface in the first rotational direction, the user maintains or increases the run or walk speed along the first advancement sense, the free wheel mechanism disengaging the first pulley from the first roller and preventing the braking action of the brake device from being transmitted to the first roller during the rotation of the physical exercise surface in a second rotational direction, the second rotational direction being opposite to the first rotational direction, the motor-less curved treadmill further comprising a frame disposed above the base and connected to the base by a pair of uprights extending in a substantially vertical direction with respect to the longitudinal axis of the base, the frame comprising upper handles disposed at a height to be gripped by a user in an upright position, and a pair of lower handles, the pair of lower handles extending from the uprights near the base and being arranged, with respect to the upper handles, closer to the physical exercise surface at a height to be gripped by the user when the user assumes a non-upright position close to the physical exercise surface, the pair of lower handles being employable by the user to perform physical exercise which comprises muscular strengthening or pushing exercise.

2. The motor-less curved treadmill according to claim 1, wherein the base is configured to allow the physical exercise surface to assume a one-way rotation mode along the longitudinal axis of the base, the base also being configured to allow the physical exercise surface to assume a two-way rotation mode along the longitudinal axis of the base.

3. The motor-less curved treadmill according to claim 1, wherein the base comprises a second pulley operatively connected to the first pulley by means of a drive belt, the second pulley being adapted to rotate around a further rotation axis parallel to the first rotation axis of the first roller and to the respective rotation axis of the first pulley, the brake device being configured to exert a braking action on the second pulley, the braking action being transmitted to the first pulley by means of the drive belt.

4. The motor-less curved treadmill according to claim 1, wherein the base comprises a second pulley integral with the first roller, the second pulley and the first roller having the same rotation axis, the second pulley being operatively connected to the first pulley by means of a drive belt, the brake device being configured to exert a braking action on the first pulley.

5. The motor-less curved treadmill according to claim 1, wherein the base also comprises:

a second free wheel mechanism operatively associated with the first roller, the second coupling device being adapted to rotate around the first rotation axis of the first roller;

a constraining device associated with the base, the constraining device being configured to selectively constrain the second coupling device to the base, when the constraining device is in the condition of constraining the second free wheel mechanism to the base, the second coupling device is configured to allow the rotation of the physical exercise surface in the first rotational direction, the second free wheel mechanism being configured to prevent the rotation of the physical exercise surface in the second rotational direction, when the constraining device is in the condition of not constraining the second free wheel mechanism to the base, the second free wheel mechanism is configured to allow the rotation of the physical exercise surface both in the first rotational direction and in the second rotational direction.

6. The motor-less curved treadmill according to claim 3, wherein the base also comprises:

a third pulley operatively connected to the first roller, the third pulley being adapted to rotate around the first rotation axis of the first roller;

a second free wheel mechanism operatively associated between the third pulley and the first roller, the second free wheel mechanism being adapted to rotate around the first rotation axis of the first roller;

a constraining device associated with the base, the constraining device being configured to selectively constrain the third pulley to the base, when the constraining device is in the condition of constraining the third pulley with the base, the second coupling device is configured to allow the rotation of the physical exercise surface in the first rotational direction, the second coupling device being configured to prevent the rotation of the physical exercise surface in the second rotational direction, when the constraining device is in the condition of not constraining the third pulley to the base, the second coupling device is configured to allow the rotation of the physical exercise surface both in the first rotational direction and in the second rotational direction.

7. The motor-less curved treadmill according to claim 5, wherein the constraining device is configured to selectively constrain the second coupling device to the base by means of shape coupling.

8. The motor-less curved treadmill according to claim 5, wherein the constraining device is configured to selectively constrain the second coupling device to the base by means of friction coupling.

9. The motor-less curved treadmill according to claim 6, wherein the constraining device is configured to selectively constrain the third pulley to the base by means of form coupling.

10. The motor-less curved treadmill according to claim 6, wherein the constraining device is configured to constrain the third pulley to the base by means of friction coupling.

11. The motor-less curved treadmill according to claim 1, wherein the physical exercise surface comprises a plurality of marking elements distributed on the physical exercise surface according to a set configuration.

12. The motor-less curved treadmill according to claim 1, wherein the frame comprises at least one upright equipped with a connection for a respective hook which the user possesses for carrying out a physical exercise on the physical exercise surface.

13. The motor-less curved treadmill according to claim 1, wherein the frame comprises at least one upright equipped with a connection for an elastic band employable by the user for carrying out a physical exercise on the physical exercise surface.

14. The motor-less curved treadmill according to claim 11, wherein the physical exercise surface comprises a plurality of strips transverse to the longitudinal axis, the plurality of marking elements being distributed on the plurality of strips according to a set configuration.

15. The motor-less curved treadmill according to claim 2, wherein the physical exercise surface comprises a plurality of marking elements distributed on the physical exercise surface according to a set configuration.

16. The motor-less curved treadmill according to claim 1, wherein the physical exercise surface comprises a plurality of marking elements distributed on the physical exercise surface according to a set configuration.

17. The motor-less curved treadmill according to claim 1, wherein the frame comprises at least one further upright equipped with a connection for a respective hook which the user possesses for carrying out a physical exercise on the physical exercise surface.

18. The motor-less curved treadmill according to claim 1, wherein the frame comprises at least one further upright equipped with a connection for an elastic band employable by the user for carrying out a physical exercise on the physical exercise surface.

* * * * *